US008974661B2

(12) United States Patent
Rennard et al.

(10) Patent No.: US 8,974,661 B2
(45) Date of Patent: Mar. 10, 2015

(54) METHODS FOR SEPARATION OF BITUMEN FROM OIL SANDS

(75) Inventors: David Carl Rennard, Houston, TX (US); Payman Esmaeili, Calgary (CA); Christopher C. H. Lin, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 345 days.

(21) Appl. No.: 13/289,755

(22) Filed: Nov. 4, 2011

(65) Prior Publication Data

US 2012/0168353 A1 Jul. 5, 2012

Related U.S. Application Data

(60) Provisional application No. 61/428,441, filed on Dec. 30, 2010.

(51) Int. Cl.
*C10G 1/04* (2006.01)

(52) U.S. Cl.
CPC ..... *C10G 1/047* (2013.01); *C10G 2300/206* (2013.01); *C10G 2300/44* (2013.01); *B03D 2203/006* (2013.01)
USPC ..... 208/390

(58) Field of Classification Search
CPC ..... C10G 1/00; C10G 1/45
USPC ..... 208/390, 391; 209/162–167; 516/136–138
See application file for complete search history.

(56) References Cited

U.S. PATENT DOCUMENTS

| | | | | |
|---|---|---|---|---|
| 4,057,486 | A | 11/1977 | Meadus et al. | |
| 4,224,102 | A * | 9/1980 | Mamers et al. | 162/5 |
| 4,406,793 | A * | 9/1983 | Kruyer | 210/669 |
| 4,740,311 | A | 4/1988 | Kruyer | |
| 5,236,577 | A * | 8/1993 | Tipman et al. | 208/390 |
| 5,911,541 | A * | 6/1999 | Johnson | 405/128.75 |
| 7,363,973 | B2 | 4/2008 | Nenniger et al. | |
| 7,540,951 | B2 | 6/2009 | Selmen et al. | |
| 7,569,137 | B2 * | 8/2009 | Hyndman et al. | 208/390 |
| 2007/0131590 | A1 * | 6/2007 | Bozak et al. | 208/390 |
| 2009/0277797 | A1 | 11/2009 | Pruet | |
| 2010/0072110 | A1 | 3/2010 | Gradek | |

FOREIGN PATENT DOCUMENTS

| | | |
|---|---|---|
| CA | 993392 | 7/1976 |
| CA | 1013695 | 7/1977 |

(Continued)

*Primary Examiner* — Prem C Singh
*Assistant Examiner* — Brandi M Doyle
(74) *Attorney, Agent, or Firm* — ExxonMobil Upstream Research-Law Department

(57) ABSTRACT

Methods of separating a viscous hydrocarbon from an ore are conducted at an oil extraction facility. The methods include transporting a slurry to a separation vessel. The transport may take place substantially without the use of an air compressor and without the injection of air into the slurry along a hydro-transport line. The methods also include mixing a plurality of beads into the slurry. The beads have a specific gravity that is less than about 0.95. The beads are used in lieu of air. The beads have an outer oleophilic surface for retaining oil, thereby aiding in the separation process. The beads are substantially coated with bitumen prior to introduction to the slurry. The method then includes separating the slurry into a first solution comprising primarily bitumen and the oleophilic beads, and a second solution comprising primarily water and sand.

36 Claims, 4 Drawing Sheets

(56) References Cited

FOREIGN PATENT DOCUMENTS

| | | |
|---|---|---|
| CA | 1027501 | 3/1978 |
| CA | 1081642 | 7/1980 |
| CA | 1094484 | 1/1981 |
| CA | 1238596 | 6/1988 |
| CA | 1239888 | 8/1988 |
| CA | 1249976 | 2/1989 |
| CA | 1272975 | 8/1990 |
| CA | 2173559 | 10/1996 |
| CA | 2200899 | 9/1998 |
| CA | 2232929 | 9/1998 |
| CA | 2217300 | 3/1999 |
| CA | 2350907 | 5/2000 |
| CA | 2272035 | 11/2000 |
| CA | 2350001 | 12/2002 |
| CA | 2353109 | 1/2003 |
| CA | 2400258 | 3/2004 |
| CA | 2454842 | 7/2004 |
| CA | 2212447 | 5/2008 |
| EP | 0249856 | 12/1987 |
| EP | 0372761 | 6/1990 |
| GB | 722419 | 1/1955 |
| GB | 1340022 | 12/1973 |
| GB | 2001670 | 2/1979 |
| GB | 2450269 | 5/2011 |

* cited by examiner

METHODS FOR SEPARATION OF BITUMEN FROM OIL SANDS

CROSS-REFERENCE TO RELATED APPLICATION

This application claims the priority benefit of U.S. Provisional Patent Application 61/428,441 filed Dec. 30, 2010 entitled Methods For Separation of Bitumen From Oil Sands, the entirety of which is incorporated by reference herein.

FIELD

The present disclosure pertains to the recovery of hydrocarbons from a subsurface formation. More specifically, the present disclosure relates to the separation of bitumen and other "heavy hydrocarbons" from a rock matrix.

BACKGROUND

Discussion of Technology

This section is intended to introduce various aspects of the art, which may be associated with exemplary embodiments of the present disclosure. This discussion is believed to assist in providing a framework to facilitate a better understanding of particular aspects of the present disclosure. Accordingly, it should be understood that this section should be read in this light, and not necessarily as admissions of prior art.

For many years, oil companies have explored for and produced hydrocarbons. While the term "hydrocarbons" generally refers to any organic material with molecular structures containing carbon bonded to hydrogen, hydrocarbons have primarily been produced in a fluid form. In a liquid state, such hydrocarbons are commonly referred to as "oil," while in a gaseous state such hydrocarbons are known as "natural gas."

Hydrocarbons typically reside in subsurface formations located many hundreds or even many thousands of feet below the earth's surface. In recent decades, energy companies have investigated the production of hydrocarbons that reside in more shallow formations, and which exist in a highly viscous form. Examples of highly viscous hydrocarbons include bitumen, asphalt, natural mineral waxes, and so-called heavy oil.

The viscosity of highly viscous or "heavy" hydrocarbons is generally greater than about 100 centipoise at 15° C. Heavy hydrocarbons may also be classified by API gravity, and generally have an API gravity below about 20 degrees. Heavy oil, for example, generally has an API gravity of about 10 to 20 degrees, whereas tar generally has an API gravity below about 10 degrees.

The term "tar" is sometimes used to describe a highly viscous, oily material. However, the naturally occurring tar in subsurface formations is technically bitumen. Bitumen is a non-crystalline, highly viscous hydrocarbon material that is substantially soluble in carbon disulfide. Bitumen may be considered somewhat of a generic term as it encompasses hydrocarbons having varied molecular structures. Among the more common molecular structures are highly condensed, polycyclic aromatic hydrocarbons. Asphaltenes are a particular subset of bitumen. Asphaltenes comprise long polymer hydrocarbons with low volatility. Asphaltenes are commonly used for paving roads and sealing roofs.

Viscous oil deposits have been located in various regions of the world. For example, viscous oil deposits have been found in abundance in the Milne Point Field on the North Slope of Alaska. Viscous hydrocarbons also exist in the Jobo region of Venezuela, and have been found in the Edna and Sisquoc regions in California. Some viscous hydrocarbons have also been located in the area near Vernal, Utah.

Perhaps the best known viscous oil, or viscous hydrocarbon, deposits reside in Canada. Extensive formations of so-called Athabasca oil sands exist in northeastern Alberta. These formations are sometimes referred to as "tar sands," though they technically contain bitumen. There are also sizable oil sands deposits on Melville Island in the Canadian Arctic, and two smaller deposits in northern Alberta near Cold Lake and Peace River. The oil sands layers contain substantial amounts of bitumen. Beneficially, the oil sands are near-surface and are largely amenable to open-pit mining.

Generally, Athabasca oil sands are composed of siliceous material with grains having a size greater than that passing a 325 mesh screen (44 microns). The oil sands also contain clay and silt. Silt has been defined as alumino-siliceous material which will pass a 325 mesh screen, but which is larger than 2 microns. Clay is material smaller than 2 microns, including some alumino-siliceous material of that size. The sand, clay, and silt together form a mineral matrix referred to as "ore."

The bitumen fills the voids between the grains in quantities of from 5 to 21 weight percent of total composition. Generally, the bitumen content of the ore is between 5 and 15 weight percent. The bitumen may contain about 4.0 to 5.0 percent sulfur, and 30 to 40 percent aromatics.

During open pit mining, the viscous oil is recovered along with the ore. This means that a process of separation must then be undertaken. Currently, the most common separation method for the Athabasca oil sands deposit is the Clark Hot Water Extraction ("CHWE") process. In this process, the mined ore is first crushed, or "ablated." This reduces the size of the mineral particles within the ore. Then, hot water is added to the ore to form a slurry. The hot water is typically at a temperature of about 40° C. to 80° C.

The slurry is transported using a hydro-transport line. Typically, the slurry is pumped from the mine site to the extraction plant to achieve both materials transport and agitation. Agitation serves to further break up the rock particles. The hydro-transport line carries the slurry to a primary separation vessel, or "PSV." There, the slurry is further agitated and exposed to air.

In many instances, a chemical such as sodium hydroxide (NaOH) is used to break up clay particles within the ore. The chemical may be injected into the slurry before the slurry is carried through the hydro-transport line. Alternatively, the chemical may be added at the PSV. In either instance, the caustic chemical drives up the pH of the mixture and further breaks up the rock material, aiding bitumen separation.

At the PSV, bitumen separates out of the slurry and floats to the surface. Where a chemical additive is used, the hydrocarbon phase rises as a bitumen froth. The bitumen froth is then removed from the top of the PSV, either through skimming or through flotation and run-off.

The recovered bitumen froth typically consists of about 60% bitumen, 30% water and 10% solids by weight. The recovered bitumen froth may be taken through a second separator. The second separator removes the contained solids and water, and serves to improve the bitumen recovery so as to meet the requirements of the downstream upgrading processes. Depending on the bitumen content in the ore and the number of separation sequences, between 80% and 100% of the bitumen can be recovered using modern hot water extraction techniques.

Water and sand are dropped out of the bottom of the second separator. The water and sand are referred to as "tailings," and are delivered together to a tailings pond. The sand and any other mineral components are allowed to settle in the tailings pond. The spent sand and other materials are ultimately returned to the mine after extraction operations are completed. The mining area is then taken through reclamation.

The use of the chemical additive along with air to delaminate or otherwise break up the clay particles and to release surfactants within the ore is detrimental to the integrity of the extraction facility. In this respect, the presence of warm caustic water and flowing abrasives deteriorates and scrapes away the inner surface of the hydro-transport line and the primary separation vessel. Further, the warm caustic water in combination with air (principally, oxygen) provides an ideal environment for the corrosion of the inner walls of the hydro-transport line and the primary separation vessel. As a result, a great deal of maintenance and replacement is required for pipes, valves, and vessels in the processing facility.

Another operational challenge for a CHWE processing facility relates to the presence of two-phase flow. In this respect, the entraining of both liquid and gas (air) requires careful attention to flow rates within the hydro-transport line. Too much air can cause kicking, while too little air can cause slugging along the pressurized hydro-transport line. Recent efforts to overcome the challenges posed by utilizing air in the process have suggested the inclusion of beads in the slurry. Exemplary publications in this area include U.S. Pat. No. 5,911,541 and U.S. Patent Publication No. 2010/0072110.

SUMMARY

The methods described herein have various benefits in improving the recovery of hydrocarbon fluids from an organic-rich rock formation, such as a formation containing solid hydrocarbons or heavy hydrocarbons. In various embodiments, such benefits may include increased production of hydrocarbon fluids from an organic-rich rock formation, and improving the recovery of bitumen at an extraction facility.

Methods of separating a viscous hydrocarbon from an ore are provided herein. The separation is conducted at an oil extraction facility. The viscous hydrocarbon preferably comprises bitumen, while the ore preferably comprises primarily sand. The ore may contain other minerals such as clay. The ore may be recovered as part of an open pit mining operation. Alternatively, the ore may represent tailings derived from a tailings solvent recovery operation.

In some implementations of the methods, the ore first undergoes ablation. This means that the ore is crushed, pulverized, ground, or otherwise broken up into much smaller pieces. The methods also include adding an aqueous fluid to the ore. This forms a slurry. Typically, this is done during or after ablation. The methods may optionally include adding a surfactant to the slurry. Alternatively, a processing aid such as caustic soda may be used to help release natural surfactants within the ore. Surfactants can help in separating the bitumen from the ore.

The methods then include transporting the slurry to at least one separation vessel. Preferably, transporting the slurry is carried out through a hydro-transport line. The slurry may be transported and initially separated at a temperature between about 25° C. and 100° C. The transport preferably takes place substantially without the use of an air compressor and without the injection of air into the slurry along the hydro-transport line. The hydro-transport line is preferably a closed pipeline to restrict the mixing of oxygen into the slurry.

The methods also include mixing a plurality of beads into the slurry. This is done at an introduction point within the extraction facility. The introduction point for the beads may be at or near a slurry inlet of the hydro-transport line. Alternatively or in addition, the introduction point may be at or near a slurry exit of the hydro-transport line. Alternatively or in addition, the introduction point may be in a separation vessel itself.

The beads have a specific gravity that is less than about 0.95. The beads may have a diameter between, for example, about 30 microns and 1 cm. In one aspect, the beads comprise substantially hollow spheres. The beads may be fabricated from plastic, glass, composite, or other light-weight but durable material.

The beads have an outer oleophilic surface. This means that the beads retain or attract oil, thereby aiding a separation process. The method then includes separating the slurry into a first solution comprising primarily bitumen and the oleophilic beads, and a second solution comprising primarily water and sand. Separation takes place at the at least one separation vessel. Preferably, the at least one separation vessel comprises a primary separation vessel and at least one secondary separation vessel. The primary separation vessel and each of the at least one secondary separation vessels releases an aqueous slurry that together form the second solution comprising sand and water.

The methods then include separating the beads in the first solution from the bitumen. In this way, the bitumen is captured. As used herein, the bitumen that is being captured may be referred to as "oil," "hydrocarbons," "hydrocarbon fluids," and/or "bitumen," interchangeably. It is to be understood that the present disclosure is directed to separating hydrocarbons from ore and/or other fluids, whatever form the hydrocarbons may take.

In a preferred arrangement, the primary separation vessel:

receives the slurry comprising bitumen, water, and sand from the hydro-transport line;

releases the first solution to an oil separator for separating the beads in the first solution from the bitumen;

releases a first portion of the second solution as a first tailings stream;

releases a middlings stream comprising bitumen, sand and water to the secondary separation vessel; and receives a third solution from the secondary separation vessel comprised primarily of beads and oil.

Further, the secondary separation vessel:

receives the middling stream from the primary separation vessel;

releases the third solution to the primary separation vessel; and releases a second portion of the second solution as a second tailings stream.

The method may further include adding a solvent to the slurry. The solvent may be added before introducing the slurry into the hydro-transport line. Alternatively or in addition, the solvent may be added before introducing the slurry into the primary separation vessel. Alternatively or in addition, the solvent may be added at the primary separation vessel. Alternatively or in addition, the solvent may be added before introducing the slurry into the secondary separation vessel. Alternatively or in addition, the solvent may be added at the secondary separation vessel. The solvent may comprise, for example, toluene, naphtha, kerosene, Varsol® solvent (available from Exxon Mobil Corporation), turpentine, bitumen, or combinations thereof. The solvent may be heated to between 30° C. and 220° C.

The beads are preferably recycled for re-use within the oil extraction facility. In some aspects, the first solution is heated in the oil separator. The first solution may be heated to a temperature between about 60° C. and 220° C. The oleophilic beads are then captured through skimming or through filtering. The beads are then transported from the first solution for re-mixing at the at least one introduction point. Transport may be through pipes, over conveyors, or via trucks.

BRIEF DESCRIPTION OF THE DRAWINGS

So that the present inventions can be better understood, certain illustrations and flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Definitions

Figure 1:
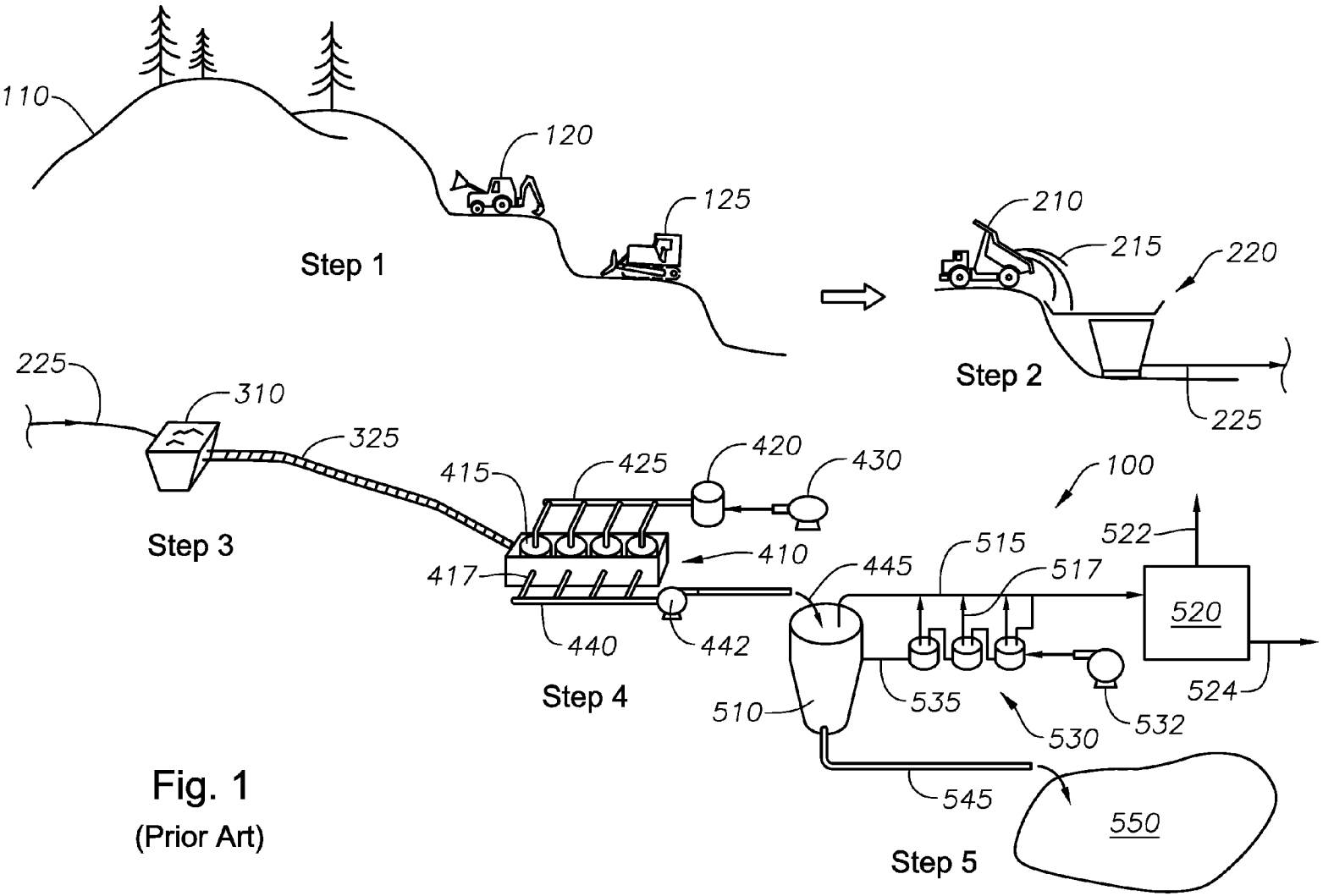
Fig. 1 (Prior Art)
FIG. 1 illustrates steps for the recovery of bitumen incident to a strip mining operation using a conventional CHWE process. The process is shown from mining to slurry preparation to de-aeration.

As used herein, the term "hydrocarbon" refers to an organic compound that includes primarily, if not exclusively, the elements hydrogen and carbon. Hydrocarbons generally fall into two classes: aliphatic, or straight chain hydrocarbons, and cyclic, or closed ring hydrocarbons, including cyclic terpenes. Examples of hydrocarbon-containing materials include any form of natural gas, oil, coal, and bitumen that can be used as a fuel or upgraded into a fuel.

As used herein, the term "hydrocarbon fluids" refers to a hydrocarbon or mixtures of hydrocarbons that are gases or liquids. For example, hydrocarbon fluids may include a hydrocarbon or mixtures of hydrocarbons that are gases or liquids at formation conditions, at processing conditions, or at 15° C. and 1 atm pressure. Hydrocarbon fluids may include, for example, oil, natural gas, coal bed methane, shale oil, pyrolysis oil, pyrolysis gas, a pyrolysis product of coal, and other hydrocarbons that are in a gaseous or liquid state.

As used herein, the term "natural gas" refers to a multi-component gas obtained from a crude oil well (associated gas) or from a subterranean gas-bearing formation (non-associated gas). The composition and pressure of natural gas can vary significantly. A typical natural gas stream contains methane ($C_1$) as a significant component. The natural gas stream may also contain ethane ($C_2$), higher molecular weight hydrocarbons, and one or more acid gases.

As used herein, the term "gas" refers to a fluid that is substantially in its vapor phase at ambient conditions (1 atm and 15° C.).

As used herein, the term "oil" refers to a hydrocarbon fluid containing primarily a mixture of condensable hydrocarbons.

As used herein, the term "fluid" refers to gases, liquids, and combinations of gases and liquids, as well as to combinations of gases and solids, combinations of liquids and solids, and combinations of gases, liquids, and solids.

As used herein, the term "condensable hydrocarbons" means those hydrocarbons that condense at about 15° C. and one atmosphere absolute pressure. Condensable hydrocarbons may include, for example, a mixture of hydrocarbons having carbon numbers greater than 4.

The term "viscous hydrocarbon" refers to a hydrocarbon material residing in a subsurface formation that is in a generally non-flowable condition. Viscous hydrocarbons have a viscosity that is generally greater than about 100 centipoise at 15° C. A non-limiting example is bitumen.

As used herein, the term "heavy oil" refers to relatively high viscosity and high density hydrocarbons, such as bitumen. Gas-free heavy oil generally has a viscosity of greater than 100 centipoise and a density of less than 20 degrees API gravity (greater than about 900 kilograms/cubic meter under standard ambient conditions). Heavy oil may include carbon and hydrogen, as well as smaller concentrations of sulfur, oxygen, and nitrogen. Heavy oil may also include aromatics or other complex ring hydrocarbons.

As used herein, the term "tar" refers to a viscous hydrocarbon that generally has a viscosity greater than about 10,000 centipoise at 15° C. The specific gravity of tar generally is greater than 1.000. Tar may have an API gravity less than 10 degrees. "Tar sands" refers to a formation that has tar or bitumen in it.

As used herein, the term "bitumen" refers to a non-crystalline solid or viscous hydrocarbon material that is substantially soluble in carbon disulfide. Bitumen may be considered somewhat of a generic term as it encompasses hydrocarbons having varied molecular structures. Among the more common molecular structures are highly condensed, polycyclic aromatic hydrocarbons. Asphaltenes are a particular subset of bitumen. Asphaltenes comprise long polymer hydrocarbons with low volatility.

As used herein, the term "subsurface" refers to geologic strata occurring below the earth's surface.

As used herein, the term "organic-rich rock formation" refers to any formation containing organic-rich rock. Organic-rich rock formations include, for example, oil shale formations, coal formations, and tar sands formations.

As used herein, the term "formation" refers to any definable subsurface region. The formation may contain one or more hydrocarbon-containing layers, one or more non-hydrocarbon containing layers, an overburden, and/or an underburden of any geologic formation. An "overburden" and/or an "underburden" are geological material above or below the formation of interest.

As used herein, the term "substantially coated" e.g., with bitumen, in the context of beads refers to a fraction greater than half of beads having at least a monolayer coating more than 50% of their surface.

An "overburden" or "underburden" may include one or more different types of substantially impermeable materials. For example, overburden and/or underburden may include sandstone, shale, mudstone, or wet/tight carbonate (i.e., an impermeable carbonate without hydrocarbons). An overburden and/or an underburden may include a hydrocarbon-containing layer that is relatively impermeable. In some cases, the overburden and/or underburden may be permeable.

The term "solvent" refers to any fluid that is significantly soluble with a particular liquid, resulting in a homogeneous mixture at the temperature and pressure of interest. Solubility amounts of the solvent in the liquid resulting in a homogeneous mixture may be greater than 10 mass percent. Non-limiting examples of solvents for hydrocarbon oils include propane, heptane, diesel, toluene, naphtha, kerosene, and mixtures of such examples.

As used herein, the term "skimming" includes capturing an overflow of fluids from a vessel, straining fluids from a top portion of a vessel, or generally removing a floating phase or matter.

The term "oleophilic" connotes any surface that exhibits a preference for being coated or wetted with a hydrocarbon rather than water.

As used herein, the term "coal" refers to any combustible rock containing more than about 50% by weight carbonaceous material, and formed by compaction and induration of plant matter.

As used herein, the terms "coal bed" or "coal seam" refer to any stratum or bed of coal. The terms may be used interchangeably herein.

Description of Selected Specific Embodiments

FIG. 1 illustrates general steps for the recovery of bitumen incident to an open pit mining operation using a conventional CHWE process. The process is shown from mining to slurry preparation to de-aeration.

A first general step, indicated at Step 1, involves overburden removal. The overburden is shown at 110. Overburden removal typically involves the use of large earth-moving equipment such as shovels 120 and bulldozers 125.

As the overburden is removed, the rock matrix containing the viscous hydrocarbon is identified. This is referred to as ore. In the illustrative arrangement of FIG. 1, the viscous hydrocarbon or ore comprises bitumen. The bitumen-containing ore is dug using the shovels 120 and bulldozers 125. The ore is then transported for crushing. The crushing step, known as ablation, is shown in FIG. 1 at Step 2.

At Step 2, a dump truck 210 is shown unloading ore 215. The dump truck 210 unloads the ore 215 into a crushing bin 220. The crushing bin 220 utilizes hammers, bits, augers, or other mechanical tools to break the ore 215 into substantially smaller pieces. Breaking the ore 215 into smaller pieces exposes the organic material within the rock matrix, facilitating extraction. The crushed ore is then exported for storage. An export path is shown at 225.

The export path 225 may be a rail line that uses large or small cargo cars. Alternatively, the export path 225 may be a conveyor line. Alternatively still, the export path 225 may be a road over which trucks carry the crushed ore. Combinations of these export means may be used.

The export path 225 carries the crushed ore 215 to a storage bin or other gathering facility 310. It is understood that in a bitumen recovery operation, ore 215 may be brought in from more than one area of open pit mining. Therefore, a central gathering facility 310 for crushed ore may be employed. The process of gathering crushed ore is provided in FIG. 1 as Step 3. The gathering facility 310 is preferably in close proximity to an extraction facility, seen at 100.

In the process of FIG. 1, the crushed ore is converted to a slurry. To do this, the crushed ore is moved from the gathering facility 310 onto a conveyor path 325. The conveyor path 325 is preferably a conveyor line. However, the conveyor path 325 may be a rail line or a road over which trucks carry the crushed ore.

In any instance, the crushed ore is taken to a slurry preparation area 410. The slurry preparation area 410 combines an aqueous fluid such as fresh water with the crushed ore. This is seen at Step 4. The slurry preparation area 410 may have a series of vats 415 in which water is mixed with the crushed ore to form a slurry. The slurry exits the vats 415 through one or more slurry lines 417.

As part of the slurry preparation of Step 4, a chemical may be added to the water and ore material. The additive may be a surfactant, or a process aide that releases natural surfactants from the ore. The surfactant separates the viscous hydrocarbon from the surface of the rock matrix. An example of a surfactant is Accepta 3543™, available from Accepta of Manchester, United Kingdom. Accepta 3543™ is an aqueous blend of soaps, synthetic detergent, solvents and inorganic alkaline builders. It is generally classified as an alkaline detergent. An example of a process aide that releases natural surfactants from the ore is caustic soda.

Other detergents or dispersants may alternatively be used. For example, a solvent-based cleaner may be employed. An example is Accepta 3540™, which contains primarily kerosene. The solvent breaks up the oil while cleaning it off of the rock particles.

The chemical additive is stored in chemical tank 420. The chemical additive is delivered to the vats 415 through chemical lines 425. In addition to the chemical additive in tank 420, in a conventional CHWE process, air is added. A compressor is shown at 430 for adding air to the slurry. In the arrangement of FIG. 1, the compressor 430 is shown adding air to the chemical additive. In this way, the chemical additive and air are pre-mixed. However, the air may be injected into the vats 415 directly.

It is noted that air and bitumen are both hydrophobic. As a result, surface energy is minimized by combining air with bitumen. This combination phase separates from water. Since bitumen is of similar density to water, the air also serves to reduce the density of the combined air and bitumen, enabling the bitumen to float on water. The bitumen may then be skimmed or otherwise separated from water in a large settling vessel.

In the CHWE process, air, bitumen, and water are mixed with mild heat. For example, the slurry may be heated in the vats 415 to 30° to 60° C. The heat allows the bitumen to become more flowable.

Once the slurry is prepared and heated in the vats 415, the slurry is delivered to the extraction facility 100 through slurry lines 417 and into a hydro-transport line 440. Additional air is typically added in the hydro-transport line 440. A second compressor is seen at 442. Adding air to the slurry in the hydro-transport line 440 facilitates the mixing of water and chemical additive (if any) with the ore. This, in turn, helps expose the bitumen.

The slurry is delivered to a primary separation vessel 510. Slurry is shown entering the separation vessel 510 at 445. Gravitational separation then takes place in the primary separation vessel 510. Water and sand generally fall to the bottom of the vessel 510 and are carried away through a primary sand slurry line 545. At the same time, oil, solvent, and other chemicals are skimmed off of the top and are carried away through an oil line 515. The oil in line 515 is taken to a de-aeration vessel 520 for the removal of air. Air is released through line 522, while oil is taken through bottom stream 524.

Typically, some additional separation of the oil from oil line 515 is carried out. In the arrangement of FIG. 1, a series of flotation cells 530 is provided. Air may be added to the flotation cells 530 using compressor 532. The air helps break oil out of the water and sand. At each cell 530, oil and air are carried away through upper lines 517. A second sand slurry is then released back into the primary separation vessel 510 through line 535.

As noted, a primary sand slurry line 545 removes sand and water from the primary separation vessel 510. The sand slurry is delivered to a tailings pond 550 for settling. The sand slurry, or "tailings," is allowed to settle. Eventually, solid mineral materials are returned to the overburden 110 as part of a reclamation project.

The operator has the option of conducting further separation operations to recapture the water from the sand and purify the water. For example, a hydrocyclone or a mesh could be used to strain sands and fines from the aqueous sand slurry in line 545. From there, conventional methods for treating produced water to remove contaminants may optionally be used. For example, settling vessels and porous media filters may be used to catch fines and particles. Biological oxidation reactors may be used to remove organic materials from the water. Thereafter, a hot lime softening vessel may be used to substantially reduce hardness and alkalinity of the water. Should the operator desire to create potable water, the filtered water may be further taken through one or more reverse osmosis filters.

The Clark Hot Water Extraction process, in combination with floatation cells 530, is efficient for extracting about 90% of the bitumen from high grade ores. However, the process does not extract enough bitumen to meet the regulatory requirements for low grade ores. The remaining bitumen remains with the mineral after extraction and is eventually deposited into the settling pond 550. The bitumen exacerbates the suspension of tailings in the water, making reclamation difficult.

The hot water process of FIG. 1 is also challenged by the presence of air in the separation facility 100. This includes the hydro-transport line 440, the primary separation vessel 510, and various valves (not shown). As noted above, air contributes to the corrosion of the metal hardware in the extraction facility 100. Therefore, a method is desired that facilitates the separation of oil from the ore without the injection of air, and without the need for large compressors 430, 442, 532.

Figure 2:
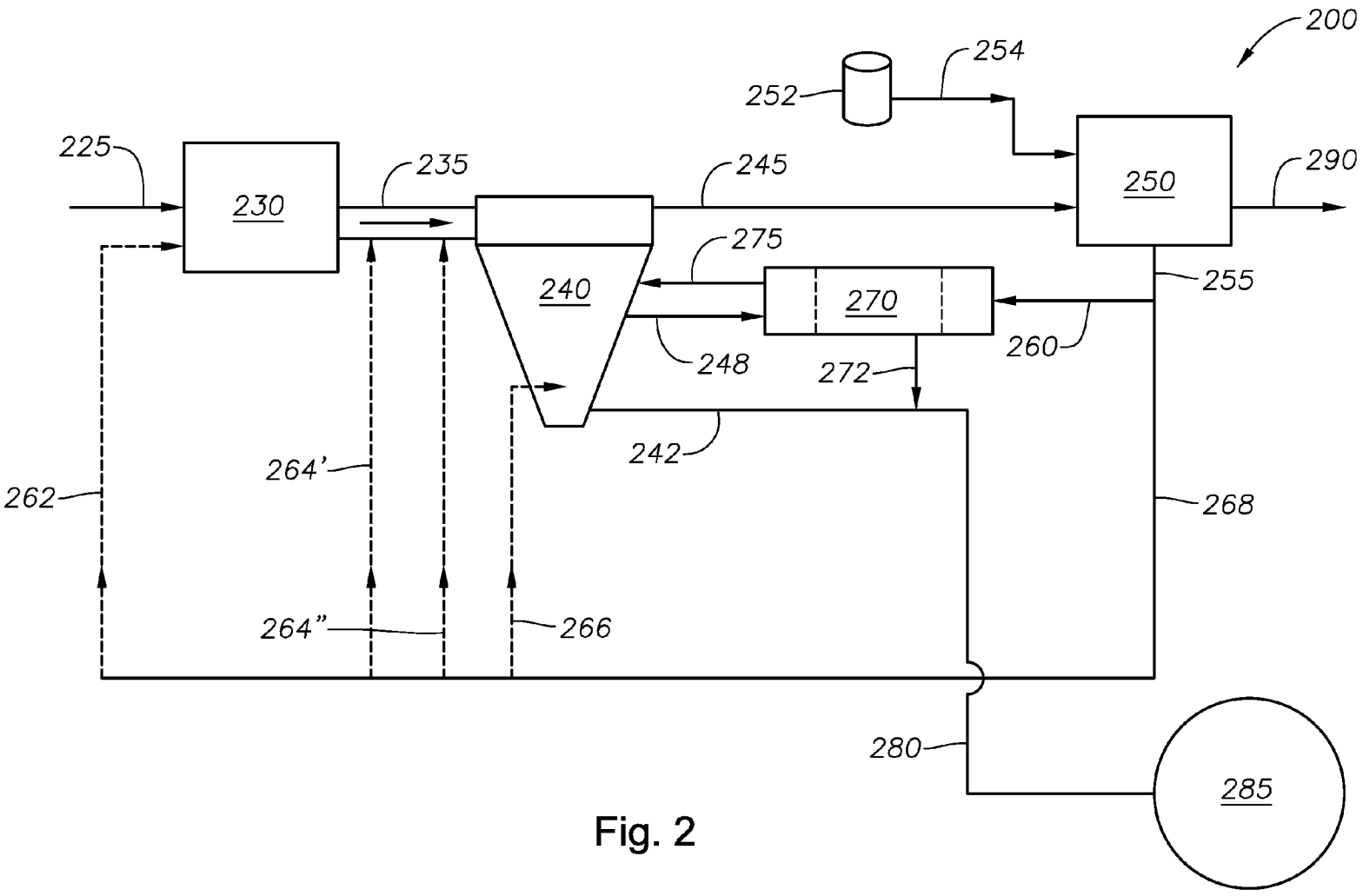
FIG. 2 illustrates steps for an exemplary modified process for the recovery of bitumen. An extraction facility is shown receiving an ablated ore, which is combined with water to form a slurry. Oleophilic beads are introduced into the extraction facility in lieu of air. The extraction facility ultimately releases oil in one stream, and a sand-water slurry in another stream.

FIG. 2 illustrates steps for an exemplary modified process for the recovery of bitumen in accordance with aspects of the present disclosure. An extraction facility 200 is shown. The extraction facility 200 is receiving an ablated ore, shown schematically at line 225. Line 225 in FIG. 2 corresponds to the export path 225 in FIG. 1. The ore from line 225 is combined with an aqueous fluid such as fresh water to form a slurry.

A slurry preparation area is shown schematically at 230. The slurry preparation area 230 may be the same as the slurry preparation area 410 of FIG. 1. The slurry aids in delaminating and breaking apart the ore to expose bitumen or other viscous hydrocarbons. The slurry further aids in separating the bitumen from the ore.

The slurry is moved through a hydro-transport line. This is shown at 235. The hydro-transport line 235 in FIG. 2 corresponds with line 440 of FIG. 1, with one notable exception: the hydro-transport line 235 does not receive an injection of air. Further, the hydro-transport line is preferably a pipeline which restricts the mixture of air into the slurry.

In lieu of air, the extraction facility 200 employs a plurality of beads. The beads may be introduced at the slurry preparation area 230, as indicated at line 262. Alternatively or in addition, the beads may be introduced at or near an inlet to the hydro-transport line 235, as indicated at line 264'. Alternatively or in addition, the beads may be introduced at or near an outlet to the hydro-transport line 235, as indicated at line 264". Alternatively or in addition, the beads may be introduced directly into a primary separation vessel 240, as indicated at line 266.

The beads are fabricated from a material that is more oleophilic than hydrophilic. For example, the beads may be fabricated from a plastic material such as polypropylene, polystyrene, polyethylene, or combinations thereof. Alternatively, the beads may be fabricated from glass. An example of a glass product is the Scotchlite™ Glass Bubbles, available from 3M of Minneapolis, Minn. Alternatively, an oleophilic composite material such as ceramic or Teflon® may be used. The above listed materials are provided as non-limiting, exemplary materials. A variety of other oleophilic materials may be used.

In some implementations, the beads may be substantially coated with bitumen prior to their introduction to the slurry. In some implementations, the use of beads substantially coated with bitumen may enhance the ability of the beads to attract bitumen from the slurry. Additionally or alternatively, the use of beads that are substantially coated with bitumen may facilitate the implementation of the processes described herein by facilitating recycle of the beads.

Figure 3:
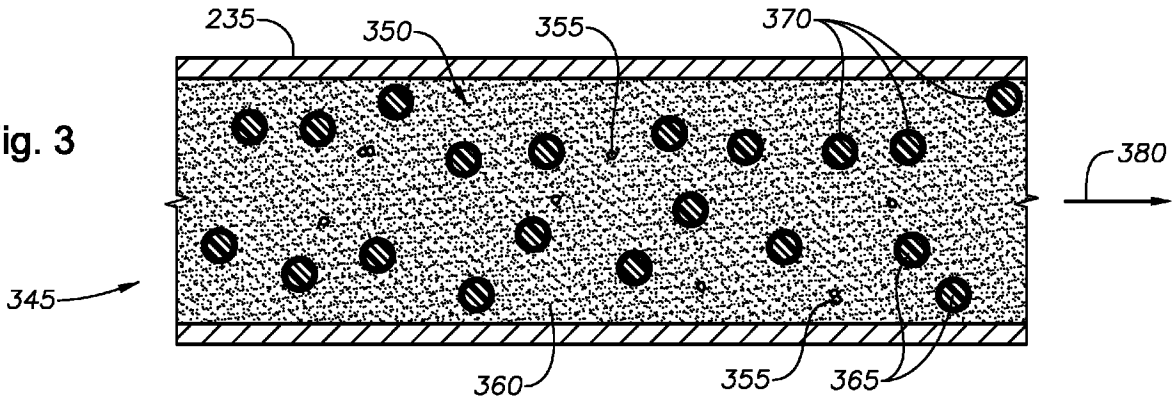
FIG. 3 is an enlarged view of an exemplary hydro-transport line for carrying slurry. Oleophilic beads are seen within the slurry.

FIG. 3 is an enlarged view of the hydro-transport line 235. The line 235 is shown in cross-section. The hydro-transport line 235 carries the slurry 345. Arrow 380 indicates a direction of slurry flow.

The slurry 345 includes pieces of crushed ore 355. This represents solids such as sand. Of course, the ore 355 will also comprise sand particles, clay, and other fines that are not large enough to be depicted in FIG. 3.

The slurry 345 includes the aqueous fluid. This is indicated generally at 350. The slurry 345 also includes droplets of oil, or bitumen 360. The oil droplets 360 float along in the slurry 345 and at least partially separate from the ore 355 during transport.

The slurry 345 may include another fluid provided as a chemical additive. For example, the operator may add a surfactant or a caustic soda to the slurry 345. For purposes of this disclosure, the term "surfactant" includes alkaline cleaners, oil dispersants, and detergents. Such additives may help in separating the bitumen from the water, separating the bitumen from the ore 355, or both.

The operator may also add a solvent. The solvent may comprise, for example, toluene, naphtha, diluted bitumen, paraffins, kerosene, or combinations thereof. The solvent may be heated before introduction into the hydro-transport line 235. The solvent reduces the viscosity of the bitumen and aids in washing the bitumen 360 from the ore 355.

Oleophilic beads 365 are also seen within the slurry 345. The beads 365 are shown in cross-section as well. The beads 365 preferably comprise spheres, though other shapes may be employed to increase surface area. The beads 365 are preferably between about 30 microns and 1 cm in diameter. Alternatively, the beads 365 may be between about 80 microns and 300 microns. Where the Scotchlite™ Glass Bubbles are used, the beads 365 will have a diameter of between 30 and 65 microns.

The oleophilic beads 365 retain or attract oil during transport. Rings of oil around the beads 365 are seen at 370. The hydrocarbon material making up the rings 370 is not diluted during initial separation in the PSV 240.

As noted, the beads 365 are introduced into the extraction facility 200 in lieu of air. Because the beads 365 are of similar volumetric size as compared to air, and because surface energy is minimized when the beads 365 mix with the bitumen phase rather than with water, phase separation occurs just as in the CHWE process. Furthermore, the beads 365 are designed to have a density that is less than water so that bitumen floatation still occurs. The beads 365 have a specific gravity that is less than about 0.95.

Figure 4B:
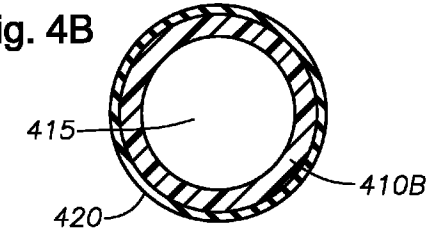
FIG. 4B presents an exemplary bead. Here, the bead is a hollow oleophilic bead. A layer of bitumen is again seen as a coat surrounding the bead.
Figure 4A:
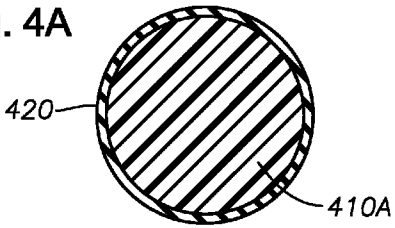
FIG. 4A shows an exemplary bead. Here, the bead is a solid object having an oleophilic outer surface. A layer of bitumen is seen as a coat surrounding the bead.

FIG. 4A shows a single bead 410A, in one embodiment. Here, the bead 410A is a solid object having an oleophilic outer surface. This is in accordance with beads 365 of FIG. 3. A layer of bitumen 420 is seen as a coat surrounding the bead 410A.

FIG. 4B presents a bead 410B in an alternate embodiment. Here, the bead 410B is a hollow sphere. A hollow interior is seen at 415. A layer of bitumen 420 is again seen as a coat surrounding the bead 410B. The interior 415 of the bead 410B may optionally be filled with a gas. Examples of such gas include air, argon, and nitrogen.

Returning to FIG. 2, the slurry and the beads are pumped into a primary separation vessel, or "PSV" 240. The slurry within the PSV 240 is optionally heated. For example, the aqueous slurry may be heated to a temperature between 25° C. and 100° C. More preferably, heating brings the aqueous slurry to between 40° C. to 100° C.

The PSV 240 operates through gravitational and phase separation. Water and sand fall to the bottom of the PSV 240 and are carried away as a first portion of a sand slurry. This is seen at line 242. At the same time, the bitumen, any chemical additive, and oil-coated beads float to the surface. After a sufficient residence time, the bitumen and beads are skimmed or otherwise filtered from the top of the PSV 240, and carried away through an oil transport line 245. In one aspect, a porous filter media is used to continually scoop the oil-soaked beads from the top of the PSV 240, with the oil-laden beads then being pushed through the oil transport line using a mechanical conveyor, gravity, fluid pressure from a solvent wash, or combinations thereof.

It is again noted that additional beads may be added to the slurry at the PSV 240 itself. Line 266 shows beads being introduced into a lower portion of the PSV 240. The low-density beads float to the top of the PSV for skimming. En route, the beads attract and pick up oil remaining in the slurry within the PSV 240.

While the foregoing discussion focused on the application of the present methods to the treatment of ores in bitumen recovery operations, it should be noted that the present systems and methods may be suitably applied in any phase of the bitumen recovery operation. For example, residual hydrocarbons may remain in the aqueous tailings streams or in other waste streams. Particularly, heavier hydrocarbons, like asphaltenes are susceptible to being separated with the sands and water rather than floated to the surface for skimming or collection with the lighter portions of the bitumen. It will be recalled that the term bitumen is being used generically to encompass the variety of viscous or heavy hydrocarbons, of which there are varying degrees of heavy hydrocarbons. In exemplary adaptations of the foregoing description, the PSV 240 may receive a slurry comprising viscous hydrocarbons, such as asphaltenes, wherein the slurry is derived from one or more tailings streams. Regardless of the source of the slurry 345 being carried in the hydro-transport line 235, the principles described herein may apply.

The bitumen and oil-soaked beads are taken through the oil transport line 245 to an oil separator 250. There, the oily slurry is separated into a beads stream and an oil stream. In the preferred embodiment, this occurs through heating or other bitumen mobilization techniques and without the use of a solvent wash. Heating may bring the oily slurry in the oil separator 250 to between 60° C. and 220° C. More preferably, heating brings the oil slurry to between 120° C. to 180° C. In another embodiment, the separation occurs at least partially through pressurization. In yet another embodiment, the separation occurs at least partially through gravitational separation or through the action of a centrifuge.

Upon heating or other bitumen separation, the beads are separated from the oil and solvent. Preferably, the beads are then extracted from the oil separator 250 by using a filter or a mesh, but may alternatively involve a hydrocylone or other solid-liquid separator. The oil separator 250 releases the separated beads through outlet line 255. At the same time, bitumen with solvent is released through line 290. The bitumen in line 290 is sent downstream for further upgrading or refining. Solvent is separated from the bitumen using a distillation or other process. The refined bitumen becomes the commercial product ultimately sought from the mining process.

It is noted that outlet line 255 will not only contain separated beads, but will also have a level of water and sand. Depending on the original quality of the ore, there may be 1 to 10 percent water and sand/fines by volume in the oil transport line 245. This material will be separated out of the oil separator 290 and fed into the outlet line 255. In addition, the separated beads will still contain some residual bitumen. For these reasons, it may be desirable to employ a secondary separation vessel 270.

The secondary separation vessel 270 preferably represents one or more flotation cells. These may be in accordance with cells 530 in FIG. 1. The secondary separation vessel 270 receives a portion of the separated beads and the sandy slurry from outlet line 255. These are delivered through line 260. In addition, the secondary separation vessel 270 optionally receives "middlings" from a middle portion of the PSV 240. The "middlings" represents a portion of the aqueous slurry that contains bitumen that has become emulsified or otherwise has not floated to the top of the PSV 240 for skimming.

Further fluid and particle separation takes place in the secondary separation vessel 270. The secondary separation vessel 270 releases oil-laden beads through outlet line 275. These oil-laden beads may be at least substantially coated by bitumen. These beads are introduced into the primary separation vessel 240 near the top of the vessel 240. At the same time, the secondary separation vessel 270 releases a second portion of sandy slurry through line 272. This second portion 272 is combined with the first sandy slurry portion 242 to form a "tailings" line 280.

The tailings represent separated water and solids. The tailings are carried from the extraction facility 200 through line 280 to a tailings pond. The tailings pond is represented schematically in FIG. 2 at 285. The tailings pond 285 corresponds to tailings pond 550 from FIG. 1. While the tailings line 280 is illustrated as being directed to a tailings pond 285, should be understood that the tailings line 280 may undergo various processing steps en route to the tailings pond. Such further processing steps may be implemented to further increase the bitumen recovery or to facilitate eventual remediation of the tailings pond area.

The majority of the heated beads and the sandy slurry from outlet line 255 are recycled back into the aqueous slurry via line 268. Thus, the recycled beads along with the sandy slurry from outlet line 255 are re-injected into either the PSV 240 (through line 266), the outlet of the hydro-transport line 235 (via line 264"), the inlet of the hydro-transport line 235 (via line 264'), the slurry preparation area 230 (via line 262), or combinations thereof. In this manner, a continuous cycling of the beads occurs.

The lines 262, 264', 264", 266, and 268 represent the transportation of beads in the extraction facility 200. Several of these lines are shown in dashed format, indicating that not all of the lines may be used by the operator. It is up to the operator to determine which of the lines 262, 264', 264", 266, 268 provides optimum bitumen recovery using the beads. Preferably, beads will be taken through each of the lines 262, 264', 264", 266, 268. The lines may represent conveyor belts, short distance rail lines, pipelines, or roads used by delivery trucks. In the example where beads are piped, they may or may not be carried by a fluid such as water or a solvent.

As can be seen from FIG. 2, the extraction facility 200 releases a first solution comprising primarily of oil and oil-laden beads in one stream (presented in line 245), and a second solution comprising primarily water and sand in another stream (presented in line 280). The first solution is further processed in an oil separator so that oil (in stream 290) is separated from the beads (outlet line 255). The oil is upgraded or refined for commercial sale, while the beads are recycled into the extraction facility 200.

Figure 5:
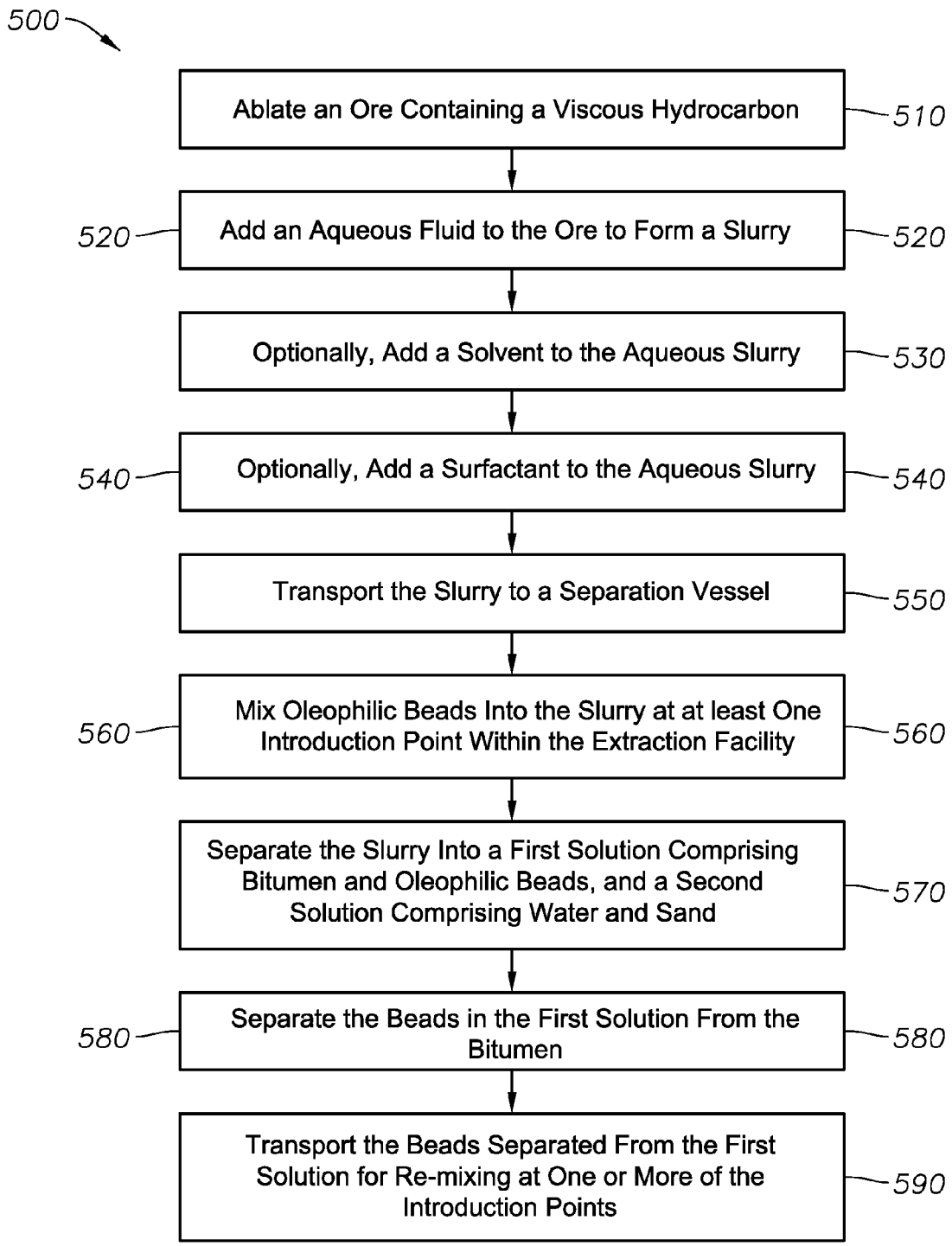
FIG. 5 provides a flowchart showing steps for an exemplary method of separating a viscous hydrocarbon from an ore at an extraction facility. The viscous hydrocarbon may be bitumen.

FIG. 5 provides a flowchart showing steps for methods 500 of separating a viscous hydrocarbon from an ore. The separation is conducted at an oil extraction facility such as facility 200. The viscous hydrocarbon preferably comprises bitumen, while the ore preferably comprises primarily sand. The ore may contain other minerals, such as clay.

In one embodiment of the method, the ore first undergoes ablation. This means that the ore is crushed or otherwise broken up into small pieces. This is indicated at Box 510.

The methods 500 also include adding an aqueous fluid to the ore. This is provided at Box 520. This forms an aqueous slurry. Typically, the step of forming a slurry of Box 520 is done after the ablation step of Box 510.

The methods 500 may optionally include adding a solvent to the aqueous slurry. This is shown at Box 530. In addition, or as an alternative, the method 500 may optionally include adding a surfactant to the slurry. This is seen at Box 540. Such additives may help in separating the bitumen from the water, separating the bitumen from the ore, or both. The additives may be added at virtually any time during the process, as described above. While the methods may include each of these steps in preparing the aqueous slurry, the methods may additionally or alternatively comprise providing an aqueous slurry through other means. For example, an aqueous slurry may be provided from a tailings stream or other process stream in a bitumen recovery operation rather than from ablated ore. The methods 500 of the present disclosure operate on a slurry having some amount of bitumen or other viscous hydrocarbon to be recovered.

The methods 500 further include transporting the aqueous slurry to an at least one separation vessel. This is indicated at Box 550. Preferably, transporting the slurry is carried out through a hydro-transport line. The slurry may be transported and initially separated at a temperature between about 25° C. and 100° C. The transport preferably takes place substantially without the use of an air compressor and without the injection of air into the slurry along the hydro-transport line.

The method 500 also includes mixing a plurality of beads into the slurry. This is provided at Box 560. The beads are mixed in at an introduction point within the extraction facility. The introduction point for the beads may be at or near a slurry inlet of the hydro-transport line. Alternatively or in addition, the introduction point may be at or near a slurry exit of the hydro-transport line. Alternatively or in addition, the introduction point may be in a separation vessel itself The beads may be fabricated from plastic, glass, composite, or other light-weight but durable material. The beads have an outer oleophilic surface. This means that the beads retain or attract oil, thereby aiding a separation process. As the beads travel through the hydro-transport line or within the extraction facility, they pick up oil from the slurry.

The methods 500 next include separating the slurry into a first solution comprising primarily bitumen and the oleophilic beads, and a second solution comprising primarily water and sand. This is seen at Box 570. Separation takes place at the at least one separation vessel. Preferably, the at least one separation vessel comprises a primary separation vessel and at least one secondary separation vessel. The primary separation vessel and each of the at least one secondary separation vessels releases an aqueous slurry that together form the second solution comprising primarily sand and water.

The method 500 also includes separating the beads in the first solution from the bitumen. This is indicated at Box 580. In this way, the bitumen is captured.

In a preferred arrangement, the primary separation vessel:

receives the aqueous slurry comprising primarily bitumen, water, and sand from the hydro-transport line;

releases the first solution to an oil separator for separating the beads in the first solution from the bitumen;

releases a first portion of the second solution as a first tailings stream to a tailings pond;

releases a middlings stream comprising bitumen, sand and water to the secondary separation vessel for further processing; and receives a third solution from the secondary separation vessel comprised primarily of beads and oil.

Further, the secondary separation vessel:

receives the middlings stream from the primary separation vessel;

releases the third solution to the primary separation vessel at or near the top of the primary separation vessel; and releases a second portion of the second solution as a second tailings stream.

The first tailings stream and the second tailings stream are each released into a tailings pond, or may undergo further treatment for separation and water purification.

The beads are preferably recycled for re-use within the oil extraction facility. In one aspect, the first solution is heated in the oil separator. The first solution may be heated to a temperature between about 60° C. and 220° C. The oleophilic beads are then captured through skimming, spinning, filtering, or combinations thereof. The beads may then be transported from the oil separator for re-mixing at the at least one introduction point. This is shown at Box 590. Transport may be through pipes, through conveyors, or through trucks.

The present disclosure teaches the use of beads in lieu of air within the oil extraction process. The advantage of beads over air is the possibility to adjust process variables such as solvent addition and temperature. In addition, abrasion is greatly reduced with the elimination of oxygen, and oil extraction is enhanced due to the beads being more oleophilic than air. In some aspects of the present disclosure, the processing of the bitumen-laden beads is adapted to provide beads to separation process that are at least substantially coated with bitumen. In some implementations, the use of beads at least substantially coated with bitumen may enhance the ability of the beads to attract bitumen from the slurry. Additionally or alternatively, the use of beads that are substantially coated with bitumen may facilitate the implementation of the processes described herein by facilitating recycle of the beads. The present disclosure has particular application to the Athabasca tar sands in Alberta, but the inventions are applicable to other viscous hydrocarbon deposits.

While it will be apparent that the inventions herein described are well calculated to achieve the benefits and advantages set forth above, it will be appreciated that the inventions are susceptible to modification, variation and change without departing from the spirit thereof.

We claim:

1. A method of separating a viscous hydrocarbon from a slurry at an extraction facility, the method comprising:

transporting the slurry to at least one separation vessel;

mixing a plurality of beads into the slurry at an at least one introduction point within the extraction facility in an absence of injecting air into the slurry, each of the plurality of beads having a specific gravity that is less than about 0.95, and each of the plurality of beads having an outer surface that is more oleophilic than hydrophilic;

separating the slurry into a first solution comprising primarily the viscous hydrocarbon and the plurality of beads, and a second solution comprising primarily water and particulates;

heating the first solution;

separating the plurality of beads in the first solution from the viscous hydrocarbon without additionally diluting the viscous hydrocarbon; and transporting a portion of the plurality of beads separated from the first solution for re-mixing at one of the at least one introduction point.

2. The method of claim 1, wherein the slurry is created by adding an aqueous fluid to an ore.

3. The method of claim 1, wherein the particulates comprise sand.

4. The method of claim 1, wherein the viscous hydrocarbon comprises asphaltenes.

5. The method of claim 4, wherein the slurry is formed at least in part from extraction tailings.

6. The method of claim 1, wherein the plurality of beads mixed into the slurry are substantially coated with bitumen prior to being mixed into the slurry.

7. The method of claim 1, wherein the slurry is transported to the at least one separation vessel through a hydro-transport pipeline and an introduction point for the plurality of beads is (i) a slurry preparation area or (ii) at or near a slurry inlet of the hydro-transport line.

8. The method of claim 1, wherein the slurry is transported to the at least one separation vessel through a hydro-transport pipeline and an introduction point for the plurality of beads is (i) at or near a slurry exit of the hydro-transport line or (ii) in the at least one separation vessel.

9. The method of claim 1, further comprising:

adding a solvent to at least a portion of the slurry at least one of (i) before introducing the at least the portion of the slurry into the hydro-transport line, (ii) before introducing the at least the portion of the slurry into a primary separation vessel, (iii) at a primary separation vessel, (iv) before introducing the at least the portion of the slurry into a secondary separation vessel, and (v) at a secondary separation vessel.

10. The method of claim 1, wherein:

the viscous hydrocarbon substantially comprises bitumen; and the ore comprises primarily sand.

11. The method of claim 10, wherein the ore further comprises clay.

12. The method of claim 10, wherein the ore is obtained from an open pit mining location.

13. The method of claim 10, wherein the ore further comprises tailings derived from a tailings solvent recovery.

14. The method of claim 1, further comprising at least partially ablating the ore before or while adding an aqueous fluid.

15. The method of claim 1, wherein the plurality of beads comprise substantially hollow spheres.

16. The method of claim 1, wherein the plurality of beads are fabricated from plastic, glass, or composite.

17. The method of claim 16, wherein the plastic comprises polypropylene, polystyrene, polyethylene, or combinations thereof.

18. The method of claim 1, wherein the plurality of beads are between about 30 microns and 1 cm in diameter.

19. The method of claim 1, wherein the plurality of beads are between about 80 microns and 300 microns in diameter.

20. The method of claim 1, wherein:

the at least one separation vessel comprises a primary separation vessel and at least one secondary separation vessel; and the primary separation vessel and each of the at least one secondary separation vessel releases a tailings slurry that together form the second solution comprising sand and water.

21. The method of claim 20, wherein the primary separation vessel:

receives the aqueous slurry comprising bitumen, water, and sand from the hydro-transport line;

releases the first solution to an oil separator for separating the plurality of beads in the first solution from the bitumen;

releases a first portion of the second solution as a first tailings stream;

releases a middlings stream comprising bitumen, sand and water to the at least one secondary separation vessel; and receives a third solution from the at least one secondary separation vessel comprised primarily of oil and oil-laden beads.

22. The method of claim 21, wherein the at least one secondary separation vessel:

receives the middling stream from the primary separation vessel;

releases a third solution to the primary separation vessel; and releases a second portion of the second solution as a second tailings stream.

23. The method of claim 22, wherein:

the third solution is received in the primary separation vessel at or near a top of the primary separation vessel; and a portion of the plurality of beads separated in the oil separator are mixed into the at least one secondary separation vessel.

24. The method of claim 9, wherein the solvent comprises toluene, naphtha, kerosene, terpentine, or combinations thereof.

25. The method of claim 9, wherein the secondary separation vessel comprises at least one flotation vessel.

26. The method of claim 1, wherein the slurry is separated in the primary separation vessel at a temperature between about 25° C. and 100° C.

27. The method of claim 20, wherein separating the plurality of beads in the first solution from the bitumen comprises capturing the plurality of beads in an oil separator through at least one of (i) skimming, (ii) spinning, (iii) filtering, (iv) shearing, and (v) heating.

28. The method of claim 27, further comprising increasing pressure in the oil separator to facilitate the separation of bitumen from the plurality of beads.

29. The method of claim 27, wherein heating comprises heating the first solution in the oil separator to a temperature between about 60° C. and 220° C.

30. The method of claim 27, wherein heating comprises heating the first solution to a temperature between about 120° C. and 180° C.

31. The method of claim 27, wherein separating the plurality of beads in the first solution from the bitumen further comprises:

contacting a heated solvent to the plurality of beads in the at least one secondary separation vessel; and capturing the plurality of beads through at least one of (i) skimming, (ii) spinning, and (iii) filtering.

32. The method of claim 31, further comprising heating the solvent to aid in separating the plurality of beads in the first solution from the bitumen to between 60° C. and 220° C.

33. The method of claim 1, further comprising adding a surfactant to the slurry before transporting the slurry to the at least one separation vessel.

34. The method of claim 1, further comprising adding caustic soda to the slurry before transporting the slurry to the at least one separation vessel.

35. A method of separating a viscous hydrocarbon from an ore at an extraction facility, the method comprising:

adding an aqueous fluid to the ore to form a slurry;

introducing the slurry to a hydro-transport line and transporting the slurry to at least one separation vessel;

mixing a plurality of beads into the slurry at at least one introduction point prior to or within the hydro-transport line in an absence of injecting air into the slurry, each of the plurality of beads having a specific gravity that is less than about 0.95, and each of the plurality of beads having an outer surface that is more oleophilic than hydrophilic;

separating the slurry into a first solution comprising primarily the viscous hydrocarbon and the plurality of beads, and a second solution comprising primarily water and sand;

transporting a portion of the plurality of beads separated from the first solution for re-mixing at one of the at least one introduction point, the portion of the plurality of beads being separated from the viscous hydrocarbons in the first solution without additionally diluting the viscous hydrocarbon.

36. A method of separating a viscous hydrocarbon from an ore at an extraction facility, the method comprising:

mixing a plurality of beads into the slurry at at least one introduction point within the extraction facility in an absence of injecting air into the slurry, each of the plurality of beads having a specific gravity that is less than about 0.95, and each of the plurality of beads having an outer surface that is substantially coated with bitumen prior to the mixing;

separating the slurry into a first solution comprising primarily the viscous hydrocarbon and the plurality of beads, and a second solution comprising primarily water and sand;

separating the beads in the first solution from the viscous hydrocarbon without additionally diluting the viscous hydrocarbon;

transporting a portion of the plurality of beads separated from the first solution for re-mixing at one of the at least one introduction point.

* * * * *